US005845186A

United States Patent [19]

Obu

[11] Patent Number: 5,845,186

[45] Date of Patent: Dec. 1, 1998

[54] WET IMAGE FORMING APPARATUS INCLUDING AN INTERMEDIATE TRANSFER BODY HAVING PROJECTIONS

[75] Inventor: Makoto Obu, Yokohama, Japan

[73] Assignee: Ricoh Company, Ltd., Tokyo, Japan

[21] Appl. No.: 888,896

[22] Filed: Jul. 7, 1997

[30] Foreign Application Priority Data

| | | | |
|---|---|---|---|
| Jul. 6, 1996 | [JP] | Japan | 8-195716 |
| Sep. 19, 1996 | [JP] | Japan | 8-269353 |
| Feb. 25, 1997 | [JP] | Japan | 9-057034 |

[51] Int. Cl.[6] ..... G03G 15/16; G03G 15/10

[52] U.S. Cl. ..... 399/308; 379/314; 430/126

[58] Field of Search ..... 399/302, 308, 399/66, 314; 430/126

[56] References Cited

U.S. PATENT DOCUMENTS

| | | | |
|---|---|---|---|
| 4,582,774 | 4/1986 | Landa | 430/126 |
| 5,233,396 | 8/1993 | Simms et al. | 399/308 |
| 5,666,193 | 9/1997 | Rimai et al. | 399/308 |

FOREIGN PATENT DOCUMENTS

| | | |
|---|---|---|
| 7-72740 | 3/1995 | Japan . |

*Primary Examiner*—Joan H. Pendegrass

*Attorney, Agent, or Firm*—Oblon, Spivak, McClelland, Maier & Neustadt, P.C.

[57] ABSTRACT

A wet image forming apparatus of the present invention includes an intermediate transfer body having an uneven surface. Projections on the uneven surface contact the surface of an image carrier and that of a paper, guaranteeing a distance between the bottoms of recesses also present on the intermediate transfer body and the above surfaces. Therefore, a toner image formed on the image carrier is prevented from being smashed by a pressure. This insures desirable transfer of the toner image from the image carrier to the intermediate transfer body, and thereby prevents image quality from being lowered on the paper.

38 Claims, 10 Drawing Sheets

WET IMAGE FORMING APPARATUS INCLUDING AN INTERMEDIATE TRANSFER BODY HAVING PROJECTIONS

BACKGROUND OF THE INVENTION

The present invention relates to a copier, facsimile apparatus, printer or similar wet image forming apparatus.

A wet image forming apparatus includes latent image forming means for forming a latent image on the surface of an image carrier. Developing means feeds a developing liquid consisting of a carrier liquid and toner dispersed therein to the surface of the image carrier, thereby developing the latent image. Transferring means transfers the developed image to a paper or similar recording medium.

A developing liquid for, e.g., wet electrophotography consists of a carrier liquid, toner dispersed therein, and a polarity control agent and binder also dispersed in the liquid in order to allow the toner to form an electric double layer. The toner is caused to migrate in the carrier liquid and deposit on the latent image by electrophoresis, thereby developing the latent image. Generally, the transfer of the developed image or toner image from the image carrier to a paper is also effected by electrophoresis. In the electrophoretic condition, toner particles gather and form an aggregation. The problem with the aggregation of toner particles is that a binding force acting between the particles is so weak, the aggregation is apt to deform when subjected to a pressure. In the case of thin lines, for example, the deformation of the aggregation results in a change in the contour of the lines, e.g., an increase in the width of the lines or the discontinuity of the lines. When the aggregation has a contour including corners, it is rounded when deformed. Further, small dots tend to turn out smaller dots while large dots tend to turn out larger dots.

To obviate the degradation of image quality ascribable to the above deformation, there has been proposed a wet image forming apparatus which increases the binding force acting between the toner particles before image transfer. This apparatus, however, has a drawback that a voltage necessary for image transfer is sometimes increased. Japanese patent application No. 8-149417 teaches a wet image forming apparatus of the type including an intermediate transfer body spaced from an image carrier by a preselected gap. The apparatus taught in this document transfers a developed image from the image carrier to the intermediate transfer body and then transfers it from the intermediate transfer body to a paper or similar recording medium. The problem with the intermediate transfer body scheme is that the gap between the image carrier and the intermediate transfer body must be maintained uniform by, e.g., rollers having a relatively great diameter. The rollers are mounted on both ends of the rotary shaft of the intermediate transfer body and held in contact with the image carrier.

The developing liquid may additionally contain spacer particles of preselected size in order to prevent the toner image from being smashed during the transfer from the image carrier to the paper, as proposed in the past. However, the problem with this kind of developing liquid is that the spacer particles are transferred to a paper together with the toner, often resulting in the degradation of image quality.

The above conventional schemes pertain to image transfer using electrophoresis based on an electric field. The various problems discussed above are also true with a wet image forming apparatus of the type using a developing liquid consisting of a carrier liquid and magnetic toner dispersed therein, and effecting image transfer by use of a magnetic field.

SUMMARY OF THE INVENTION

It is therefore an object of the present invention to provide a new and useful wet image forming apparatus capable of reducing the deformation of the aggregation of toner during image transfer.

An image forming apparatus using a developing liquid consisting of a carrier liquid and toner dispersed therein includes a latent image forming device for forming a latent image on the surface of an image carrier. A developing unit feeds the developing liquid to the surface of the image carrier to thereby develop the latent image. A transferring device transfers the developed image formed by the developing unit to a recording medium. The transferring device has an intermediate transfer body having a number of projections on the surface thereof and located to face the image carrier such that the projections contact the surface of the image carrier, a first transferring section for forming either an electric field or a magnetic field for toner transfer between the image carrier and the intermediate transfer body, and a second transferring section for transferring the developed image transferred from the image carrier to the intermediate transfer body by the electric field or the magnetic field to the recording medium.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
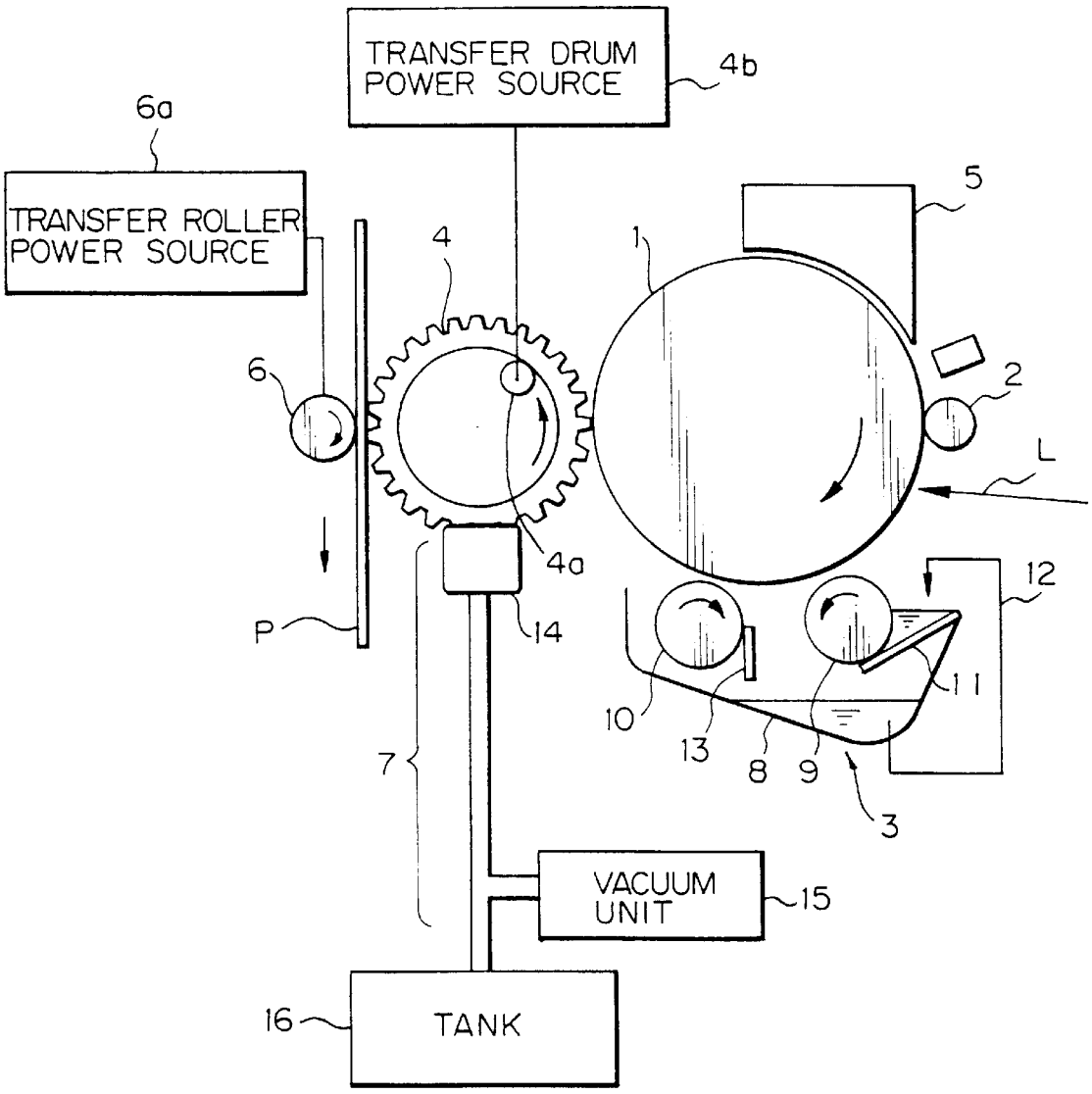
FIG. 1 is a fragmentary view of a wet image forming apparatus embodying the present invention.

Referring to FIG. 1 of the drawings, a wet image forming apparatus embodying the present invention is shown and implemented as an electrophotographic copier by way of example. As shown, the copier includes a photoconductive drum 1 playing the role of an image carrier. Arranged around the drum 1 are a charge roller 2, an exposing device, not shown, a developing unit 3, an intermediate transfer drum or transfer body 4, and a cleaning unit 5. The intermediate transfer drum 4 has an uneven surface. A transfer roller or transferring means 6 faces the intermediate transfer drum 4 in order to transfer a developed image to a paper or similar recording medium P. A cleaning device 7 cleans the surface of the intermediate transfer drum 4.

While the drum 1 is rotated in the direction indicated by an arrow in FIG. 1, the charge roller 2 charges the surface of the drum 1. The exposing device exposes (L) the charged surface of the drum 1 so as to form a latent image thereon. The developing unit 3 develops the latent image while removing an excessive part of the excessive developing liquid.

Specifically, the developing unit 3 includes a casing 8 storing a two-ingredient type developing liquid in its bottom portion. The casing 8 is open at its portion facing the drum 1. A developing roller 9 and a squeeze roller 10 are disposed in the open portion of the casing 8. These rollers 9 and 10 respectively play the role of a developer feeding/electrode member and means for removing the excessive developing liquid. The developing roller 9 is located upstream of the squeeze roller 10 in the direction of rotation of the drum 1. The developing roller 9 is rotated in the same direction as the drum 1 at a position where the roller 9 faces the drum 1. A preselected bias voltage for development is applied from a power source, not shown, to the developing roller 9. A scraper 11 is held in contact with the developing roller 9, forming a liquid well between the scraper 11 and the roller 9. The developing liquid is fed from the bottom portion of the casing 8 to the liquid well via a piping 12. The developing roller 9 in rotation conveys the developing liquid from the above liquid well to the surface of the drum 1. As a result, toner contained in the developing liquid is deposited on the latent image so as to develop it. The squeeze roller 10 is rotated in the opposite direction to the drum 1 at a position where the roller 10 faces the drum 1. The squeeze roller 10 removes an excessive part of the developing liquid, particularly carrier liquid, from the drum 1. A scraper 13 is held in contact with the squeeze roller 10, as illustrated.

The surface portion of the drum 1 from which the excessive developing liquid has been removed faces the intermediate transfer drum 4 due to the rotation of the drum 1. As a result, the toner image is transferred from the surface of the drum 1 to the drum 4. The drum 4 intervenes between the drum 1 and the paper P in order to prevent the toner image from being deformed at the time of transfer, as will be described in detail later. At the position where the drums 1 and 4 contact each other, an electric field for causing the toner to move from the drum 1 toward the drum 4 by electrophoresis is formed, as will also be described in detail later.

When the paper P is conveyed to the position where the intermediate transfer drum 4 and transfer roller 6 face each other by conveying means, not shown, the toner image is transferred from the drum 4 to the paper P. In the illustrative embodiment, the image transfer from the drum 4 to the paper P is also effected by an electric field. For this purpose, a preselected voltage is applied, e.g., from a transfer roller power source 6*a* to the transfer roller 6, as shown in FIG. 1.

The cleaning device 7 removes the developing liquid remaining on the surface portion of the intermediate transfer drum 4 from which the toner image has been transferred to the paper P. In the illustrative embodiment, cleaning means is made up of a collecting chamber 14 having an opening facing the drum 4, and a vacuum unit 15 for evacuating the inside of the chamber 14. Such cleaning means may be replaced with, e.g., a rubber blade or an urethane foam body for wiping off the developing liquid. In any case, the developing liquid removed from the drum 4 is collected in a tank 16. Because the developing liquid collected in the tank 16 contains dust deposited on the paper and paper dust, it is discarded.

The cleaning unit 5 assigned to the drum 1 removes the developing liquid remaining on the surface portion of the drum 1 from which the toner image has been transferred to the intermediate transfer drum 4. The developing liquid collected by the cleaning unit 5 may be returned to the developing unit 3 and used again thereby.

Figure 2A:
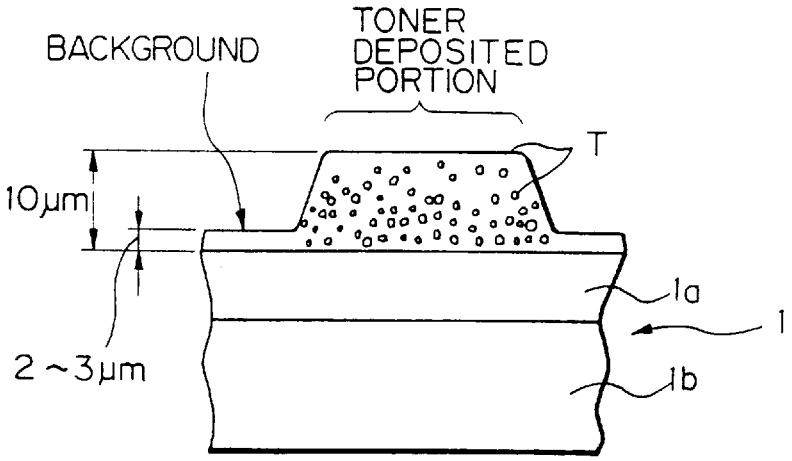
FIG. 2A shows a film formed by a developing liquid on a photoconductive element included in the embodiment.
Figure 2B:
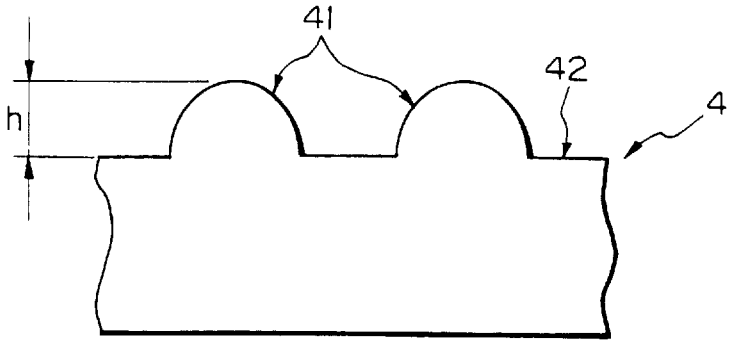
FIG. 2B shows the surface configuration of an intermediate transfer body also included in the embodiment.

The intermediate transfer drum 4 prevents the toner image from being deformed at the time of transfer, as follows. The drum 4 has an uneven surface, as mentioned earlier. FIG. 2B shows a specific configuration of the surface of the drum 4 and consisting of projections 41 and recesses 42. When the drum 4 with such a surface configuration is pressed against the drum 1 and paper P, gaps are guaranteed between the recesses 42 and the drum 1 and between the recesses 42 and the paper P, as shown in FIG. 2B. With these gaps, it is possible to protect the toner image from deformation.

As shown in FIG. 2B, the projections 41 have a height h so selected as to prevent the toner image from being deformed at the time of transfer from the drum 1 to the drum 4. The height h should preferably be selected on the basis of the developing liquid forming a film and sequentially brought to the position where the drums 1 and 4 face each other, particularly the height of the aggregation of toner and the thickness of the film. Specifically, the height h should preferably be greater than the height of the aggregation of toner deposited on the drum 1 in order to prevent the aggregation from being smashed. It is to be noted that the thickness of the film and the height of the aggregation of toner are dependent on the conditions for forming the latent image and the developing conditions (including a gap for development, linear velocity of the developing roller 9, bias for development, viscosity of the developing liquid, and squeezing conditions including the linear velocity of the squeeze roller 10 and a squeeze gap). This will be described more specifically hereinafter, giving specific numerical values.

Assume that the viscosity of the developing liquid is as low as the viscosity of water. Then, if the gap between developing roller 9 and the drum 1 is 150 $\mu$m, the developing liquid forms an about 30 $\mu$m thick film on the surface of the drum 1 moved away from the roller 9. At this stage, the film thickness does not differ from the portion where the toner is deposited to the portion where it is not deposited, i.e., the background.

The squeeze roller 10 is spaced from the drum 1 by a gap of about 50 $\mu$m. Although the thickness of the film moved away from the squeeze roller 10 depends on the rotation speed of the roller 10, it is about 10 $\mu$m in the portion where the toner is deposited or about 2 $\mu$m to 3 $\mu$m in the background when squeezed by the maximum ability. FIG. 2A models the difference between the above thicknesses. Of course, the rotation speed of the roller 10 may be so controlled as to implement greater thicknesses. In the portion where the toner is deposited, up to about 10 $\mu$m of the film formed by the maximum ability of the roller 10 contains dense toner, i.e., it is the height of the aggregation of toner. This can also be seen from the fact that when the rotation speed of the roller 10 is changed in order to form an about 20 $\mu$m thick film in the portion where the toner is deposited, the weight of the toner (excluding the weight of the carrier liquid) on the drum 1 remains the same as when the film thickness is 10 $\mu$m.

Under the above specific conditions, the height h of the projections 41, FIG. 2B, should preferably be greater than 10 μwhich is the height of the aggregation of toner. With this configuration, it is possible to prevent the about 10 μm high aggregation of toner in the portion of the drum 1 where the toner is deposited from being smashed.

Further, the height h of the projections 41 should preferably be selected in accordance with the thickness of the film form ed in the portion of the drum 1 where the toner is deposited. This is to obviate an occurrence that the above film fails to contact the surface of the intermediate transfer drum 4 and cannot be transferred by electrophoresis in the expected manner, resulting in the local omission of the image. Specifically, the height h should preferably be such that the developing liquid in the portion of the drum 1 where the toner is deposited can contact the bottoms of the recesses 42 of the drum 1. In the above specific conditions, it is preferable that the height h be less than about 10 μm which is the height of the film formed in the portion of the drum 1 where the toner is deposited. If the developing liquid is caused to form a 20 μm thick film in the portion where the toner is deposited, then the height should preferably be less than 20 μm.

Figure 3A:
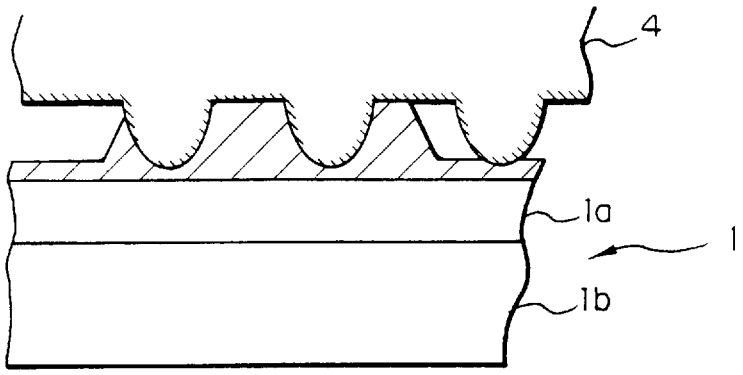
FIGS. 3A, 3B, 4A and 4B each shows a particular condition of toner transfer from the photoconductive element to the intermediate transfer body.

As shown in FIG. 3A, when the above height h is selected, the gaps between the drum 1 and the bottoms of the recesses 42 are filled with the developing liquid in the portion where the toner is deposited. In this condition, the toner can be transferred even to the bottoms of the recesses 42 by electrophoresis occurring in the developing liquid, realizing faithful image transfer.

Figure 3B:
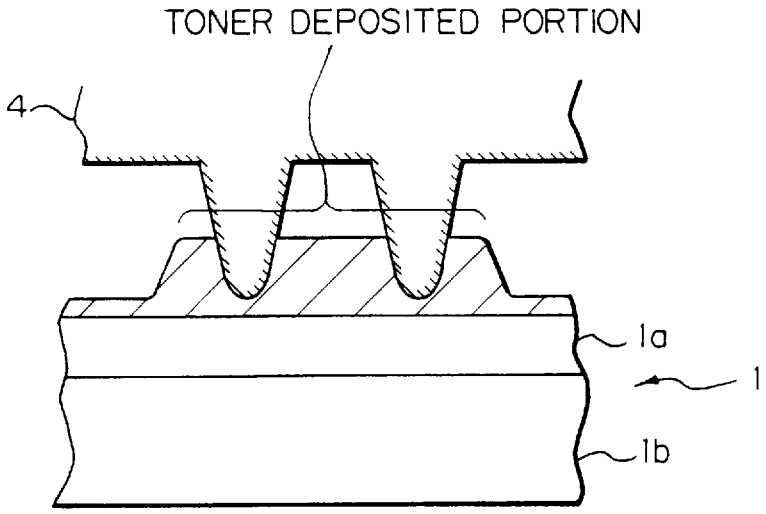

FIG. 3B shows a condition wherein the height h is so great, compared to the thickness of the film on the drum 1, the film in the portion where the toner is deposited partly fails to contact the surface of the intermediate transfer drum 4. In such a part, the toner is not transferred from the drum 1 to the drum 4. In order to obviate this kind of local omission of the image, it is preferable that the height h be not excessively great, compared to the thickness of the film in the portion where the toner is deposited.

As shown in FIGS. 3A and 3B, if the height h is so selected as to prevent the bottoms of the recesses 42 from contacting the film existing in the background of the drum 1, the developing liquid (mainly carrier liquid) in the background of the drum 1 can be prevented from being transferred to the drum 4. This successfully obviates the wasteful consumption of the developing liquid.

Figure 4A:
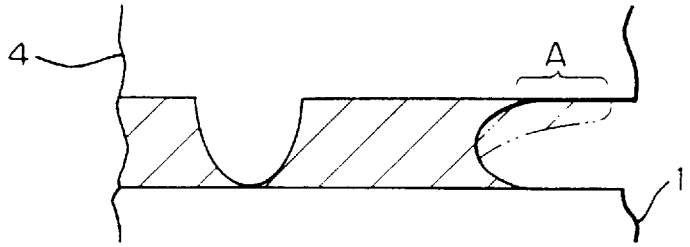
Figure 4B:
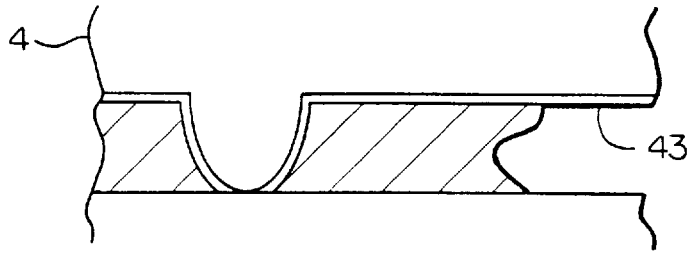

FIG. 4A shows a condition wherein the film of the developing liquid deposited on the drum 1 has a thickness greater than the height h. In FIG. 4A, a solid line is representative of the distribution of the liquid to occur when the thickness of the film matches the height h. In a portion A indicated by a dash-and-dots line, the portion of the liquid exceeding the height h is forced out of the area of the drum 1 in which the toner is deposited; the toner might be scattered around along the liquid forced out, depending on the situation. To obviate this occurrence, as shown in FIG. 4B, the surface of the intermediate transfer drum 4 should preferably be so treated as to form an oil-repellent layer 43. The oil-repellent layer 43 increases the contact angle between the surface of the drum 4 and the liquid (the embodiment uses a petroleum-based carrier liquid). As a result, the distance over which the liquid is forced out is maintained relatively short.

Figure 5A:
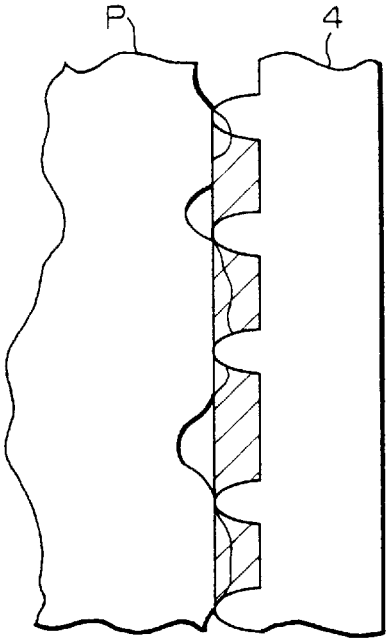
FIGS. 5A and 5B each shows a particular condition of toner transfer from the intermediate transfer body to a recording medium.
Figure 5B:
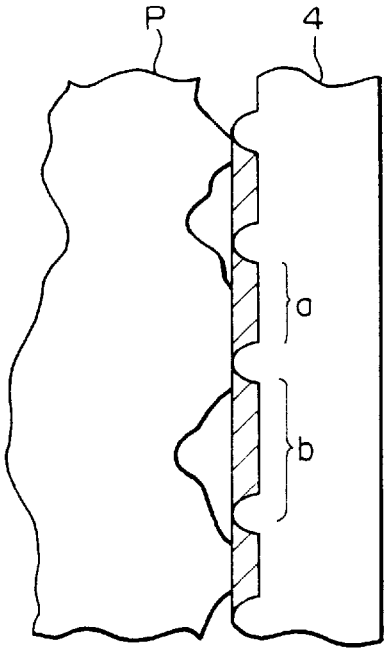

It is preferable to set the thickness of the film formed by the developing liquid in the portion of the intermediate transfer drum 4 where the toner is deposited. This is to obviate the local omission of the toner image at the time of transfer from the drum 4 to the paper P. Specifically, if the height h is so selected as to protect the toner image from deformation at the time of transfer from the drum 1 to the drum 4, as stated above, the image can be protected from deformation also at the time of transfer from the drum 4 to the paper P because of the gap defined by the projections. This is true so long as the thickness of the film formed in the portion of the drum 4 where the toner is deposited is adequate, as shown in FIG. 5A. However, if the thickness of the film is short, as shown in FIG. 5B, it is likely that the film in the above portion and facing dimples existing in the surface of the paper P fail to contact the paper P and cannot be transferred by electrophoresis. This also results in the local omission of the toner image on the paper P. In FIG. 5B, the dimples of the paper P do not exist in a portion a, but exist in a portion b; the local omission occurs in the portion b. Further, coated papers, slightly coated papers and plain papers each has a particular degree of unevenness on the surface. To avoid the local omission of the kind described above, it is preferable to set the thickness of the developing liquid in the portion of the drum 4 where the toner is deposited in accordance with the kind of papers to be used. This can be done on the basis of the thickness of the developing liquid existing on the drum 1, e.g., by controlling the rotation speed of the squeeze roller 10, FIG. 1.

As stated above, from the standpoint of the protection of the toner image from deformation and the elimination of the local omission at the time of transfer from the drum 1 to the drum 4, the height h of the intermediate transfer drum 4 is also determined in accordance with the thickness of the film of the drum 1 determined from the standpoint of the elimination of the local omission at the time of transfer from the drum 4 to the paper P. For example, under the specific conditions of the copier of FIG. 1 described previously, the 10 μm thick film of the developing liquid can be desirably transferred only to extremely smooth coated papers. As the smoothness decreases, a greater amount of carrier liquid is required for causing the toner to move from the drum 4 to the paper P by electrophoresis. The thickness of the film and the height h of the projections are preferably be 10 μm to 20 μm for coated papers, or 20 μm to 40 μm for slightly coated papers, or 40 μm to 60 μm for plain papers.

The intermediate transfer drum 4 and the arrangements for forming the electric fields for image transfer will be described more specifically hereinafter. To form the electric fields, the drum 4 itself may be used as an electrode, in which case a voltage will be applied to the drum 4. The drum 4 may be formed of metal and may be provided with the uneven surface by, e.g., etching. A specific implementation for applying the voltage to the drum or electrode 4 is shown in FIG. 1. As shown, an electrode member 4*a* in the form of, e.g., a roller or a brush is held in contact with a part of the drum 4 which is implemented as a sleeve by way of example. A voltage is applied from a transfer drum power source 4*b* to the drum 4 via the electrode member 4*a*.

However, because the tips of the projections formed on the drum 4 are formed of metal, leak is apt to occur due to the electric field formed by the voltage when the tips contact the drum 1. The voltage for forming the desired electric field is effected by the height h of the projections of the drum 4; the former increases with an increase in the latter. Therefore, the leak occurs more easily as the height h increases. It follows that when the drum 4 has a structure likely to bring about the leak, the drum 1 must be implemented by a photoconductive material which will be damaged little by the leak.

Figure 6A:
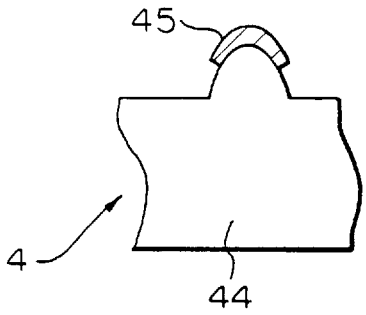
FIGS. 6A–6C, 7A and 7B each shows a specific configuration of the intermediate transfer body.
Figure 6B:
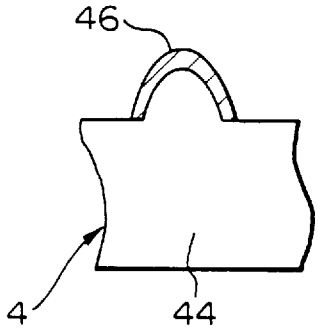
Figure 6C:
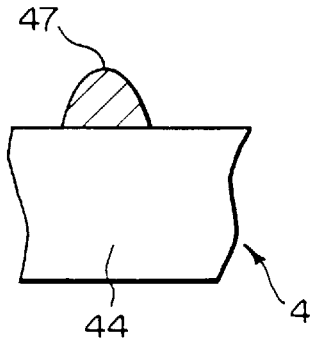

FIGS. 6A–6C, 7A and 7B each shows a specific configuration of the drum 4 capable of obviating the above leak and thereby broadening the range of photoconductive materials applicable to the drum 1. In FIG. 6A, the drum 4 has a base 44 formed of metal and projections each having only the respective tip portion covered with an insulator 45. The configuration shown in FIG. 6B is similar to the configuration of FIG. 6A except that each projection is entirely covered with an insulator 46. The configuration shown in FIG. 6C is also similar to the configuration of FIG. 6A except that each projection is entirely formed of an insulator 47. The insulators 45–47 may each be replaced with a material having a medium electric resistance lying in the range of $10^6$ Ωcm to $10^{10}$ Ωcm or so. Insulators have resistances above $10^{14}$ Ωcm. Of course, use may be made of a material whose resistance is about $10^{10}$ Ωcm to $10^{13}$ Ωcm. The configuration of FIG. 6B is superior to the configuration of FIG. 6A in respect of the prevention of the leak to the drum 1 or the transfer roller 6 facing the drum 4. The configuration of FIG. 6C is even superior to the configuration of FIG. 6B in the same respect.

Figure 7A:
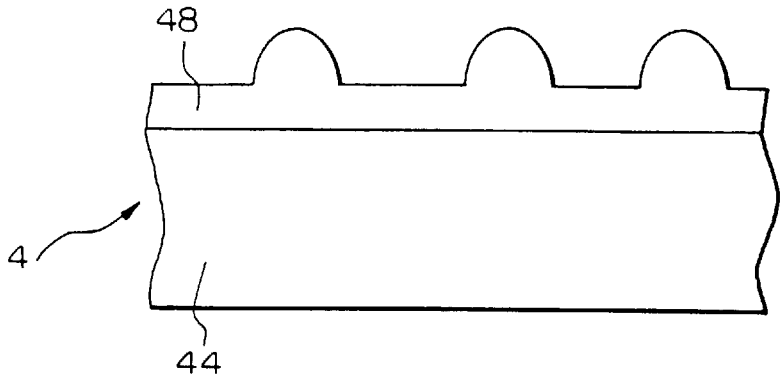
Figure 7B:
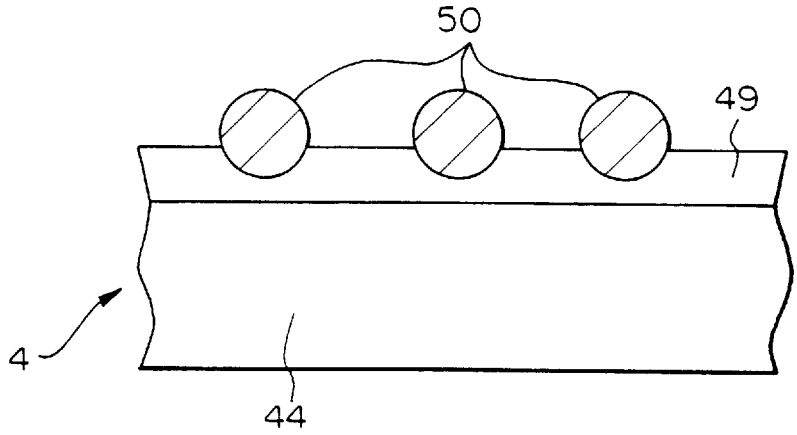

In FIG. 7A, a layer 48 of a material having a medium resistance or of an insulator is formed on the metallic base or roller 44. In this case the projections are formed of the same material as the layer 48. The configuration shown in FIG. 7B is similar to the configuration of FIG. 7A except that projections 50 are formed of a material different from the material of a layer 49 formed on the base 44. The projections 50 shown in FIG. 7B may be implemented as spherical members; the height h can be selected on the basis of the depth to which the members 50 are buried in the layer 49 and the diameter of the members 50.

If desired, the entire drum 4 including the uneven surface may be formed of metal and has its entire surface coated with a medium resistance material or an insulator.

Among the above specific configurations, those covering the entire surface of the drum 4 with a medium resistance material or an insulator are capable of eliminating the leak not only at the projections but also at the recesses. The material constituting the surface of the drum 4 in any one of such configurations may be oil-repellent in order to achieve the advantage described previously.

Referring to FIGS. 8–11, an alternative embodiment of the present invention will be described. In this embodiment, the electric field between the drums 4 and 1 and the electric field between the drum 4 and paper P each is formed by a particular member located at the respective preselected position. Assume that the height h of the projections of the drum 4 is increased in order to promote desirable image transfer from the drum 1 to the drum 4. Then, at the time of transfer from the drum 4 to the paper P, gaps are formed between the bottoms of the recesses of the paper P and the surface of the developing liquid existing on the drum 4, as stated with reference to FIG. 5B. It is therefore likely that the electrophoresis of the toner cannot avoid the local omission of the toner image alone. This is particularly true when use is made of plain papers whose fibers appear on the surfaces and form numerous dimples.

In light of the above, the electric field for transfer from the drum 1 to the drum 4 (first transfer hereinafter) is implemented as one adequate for the electrophoresis of toner in the developing liquid. The electric field for transfer from the drum 4 to the paper P (second transfer hereinafter) is implemented as one adequate for the toner to fly even when gaps are produced between the surface of the paper P and the developing liquid existing on the drum 4, as stated earlier. The two electric fields each directed toward a particular purpose are formed by independent members located at preselected positions.

Figure 8:
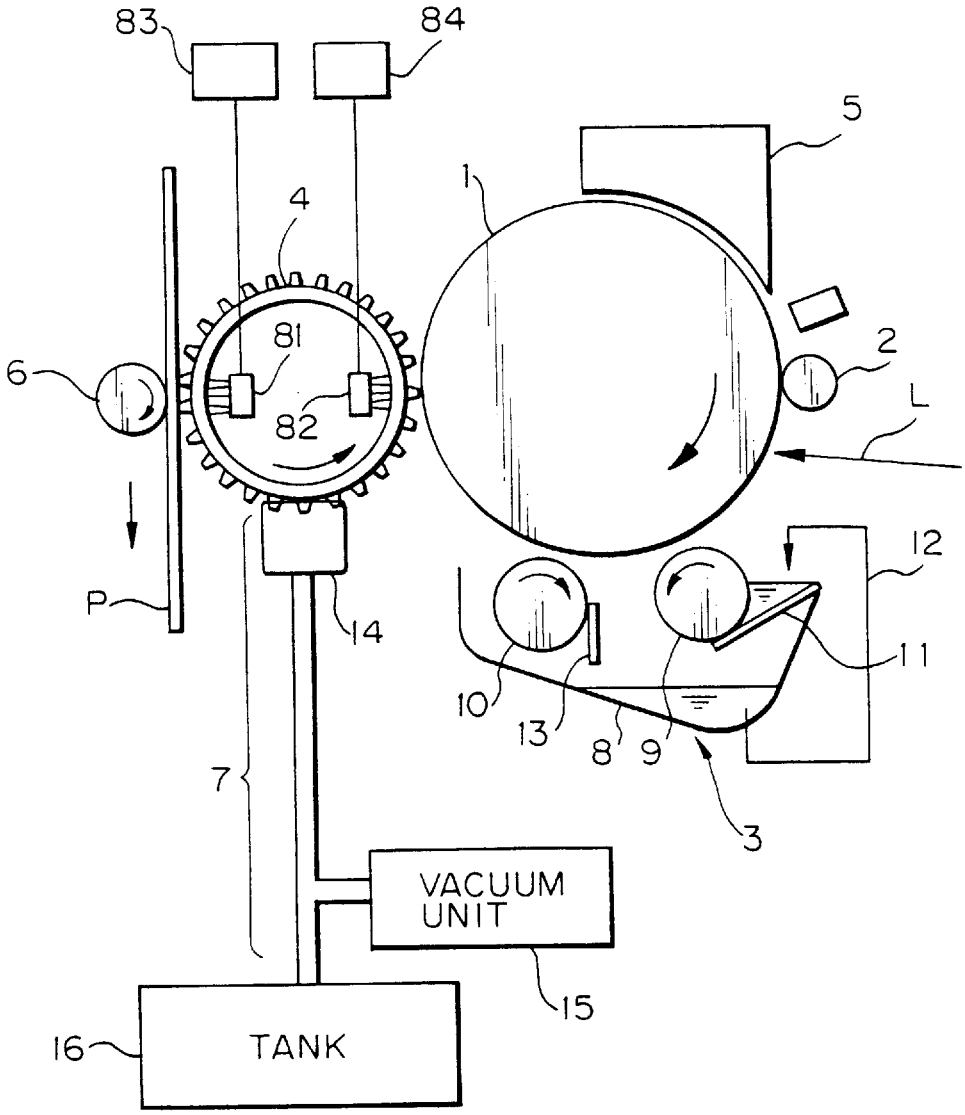
FIG. 8 is a fragmentary view of an alternative embodiment of the present invention.

Specifically, as shown in FIG. 8, the drum 4 has a hollow cylindrical configuration. Voltage applying members 82 and 81 are disposed in the drum 4 and respectively assigned to the electric field for the first transfer and the electric field for the second transfer. The voltage applying members 82 and 81 are located to face the drum 1 and transfer roller 6, respectively. In the illustrative embodiment, the two members 82 and 81 are implemented as brush electrodes members contacting the inner periphery of the drum 4. Power sources 83 and 84 respectively apply voltages to the electrode members 81 and 82, respectively. The drum 4 is formed of a medium resistance material or an insulator such that the surface potential of the portion of the drum 4 facing the drum 1 is determined by the voltage of the electrode member 82, and such that the surface potential of the portion of the drum 4 facing the transfer roller 6 is determined by the voltage of the other electrode member 81. With this kind of material, it is also possible to obviate the leak from the projections and recesses of the uneven surface of the drum 4.

Figure 9A:
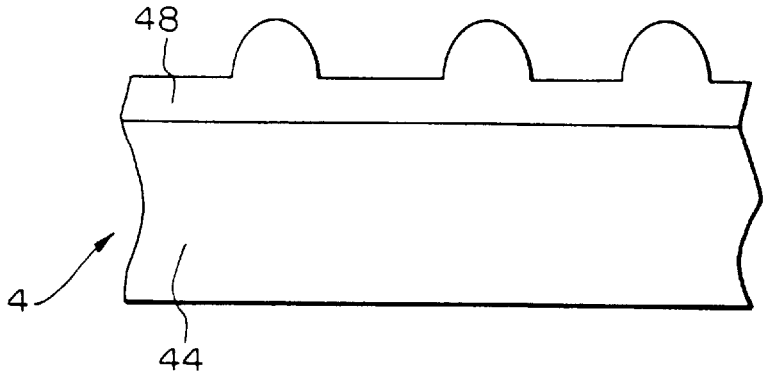
FIGS. 9A and 9B each shows a specific configuration of an intermediate transfer body included in the alternative embodiment.

As shown in FIG. 9A, the drum 4 may have a base 44 formed of a medium resistance material or an insulator, and a surface layer 48 formed on the base 44 and including the projections. Alternatively, as shown in FIG. 9B, the drum 4 may have, e.g., spherical particles 50 forming the projections buried in the above base 44.

Figure 9B:
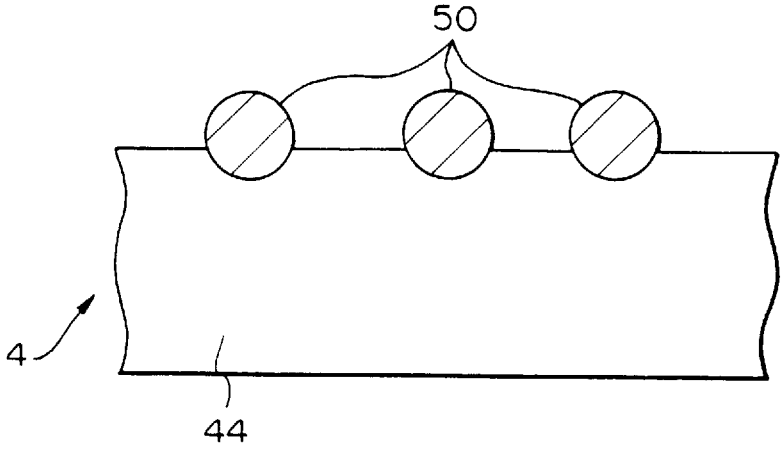

In each of the configurations shown in FIGS. 9A and 9B, the base 44 is implemented as a hollow cylinder formed of a medium resistance material or an insulator. The insulator has a resistance above $10^{14}$ Ωcm. The medium resistance lies in the range of from $10^6$ Ωcm to $10^{10}$ Ωcm or so. Of course, use may be made of a material whose resistance is about $10^{10}$ Ωcm to $10^{13}$ Ωcm. The surface layer 48 and particles 50 are also formed of a medium resistance material like the base 44 although they may be the same as or different from the base 44 as to the specific material. Preferably, the surface layer 48 and particles 50 should each be formed of a material which does not easily come off from the base 44.

The electric field for the first transfer transfers the toner by electrophoresis, and should therefore be about 5 V/μm. On the other hand, the electric field for the second transfer should be about 10 V/μm because it must transfer the toner via the gaps between the bottoms of the dimples of the paper P and the developing liquid existing on the drum 4. To increases the probability of the flight of the toner, it is desirable to use an AC electric field or a pulse-like electric field which will promote the movement of the toner. The AC electric field or the pulse-like electric field may be one causing the toner to fly only from the drum 4 toward the paper P, instead of reversing the direction of flight alternately, on the basis of a DC component. As for the AC electric field, the frequency should preferably be high enough to prevent irregularities of toner transfer ascribable to the alternation of the electric field from appearing in the image in the form of a stripe pattern. However, should this frequency be excessively high, there would occur electric transfer losses and electric troubles. The adequate frequency range is, e.g., from 100 Hz to 500 Hz.

Specific voltages to be applied to the voltage applying members 82 and 81, as well as other factors, are dependent on the material of the drum 4.

Assume that the AC electric field or the pulse-like electric field is used as the electric for the second transfer. Then, an arrangement may be made such that the voltage component for forming the above electric field and for promoting the movement of the toner is applied mainly to the member 81 while the DC component for causing the toner to move from the drum 4 toward the paper P is applied mainly to the transfer roller 6. Further, the member 81 may be connected to ground to serve as a counter electrode, in which case the voltage assigned to the second transfer will be applied to the transfer roller 6.

Because a relatively high voltage is applied to the member 81 assigned to the second transfer, the drum 4 should preferably be formed of a material withstanding a relatively high voltage, e.g., several kilovolts.

As stated above, in the illustrative embodiment, the electric field for the first transfer is implemented as one adequate for toner transfer based on electrophoresis. In addition, the electric field for the second transfer is implemented as one adequate for the toner to fly even when gaps are produced between the paper P and the developing liquid on the drum 4 due to the uneven surface of the paper P. Therefore, attractive images free from local omission are achievable even when plain papers are used.

Coated papers, slightly coated papers and plain papers each has a particular degree of surface irregularity, as stated earlier. Particularly, a coated paper has an extremely smooth surface and cannot absorb the developing liquid as much as a plain paper. Consequently, the required gap between the surface of the coated paper and that of the drum 4 is almost filled with the developing liquid, as shown in FIG. 5A by way of example. Therefore, if the coated sheet is used and if the electric field for the second transfer is of the kind reversing the direction of flight of the toner alternately (AC electric field or pulse-like electric field), the toner is apt to move back and forth in the developing liquid and lower image quality. By contrast, the surface of a plain paper absorbs the developing liquid, and in addition traps the toner deposited between its fibers. The plain paper therefore does not lower image quality even if the above particular voltage is used. In this manner, the adequate electric field for the second transfer depends on the kind of the paper P and should preferably be switched in accordance with the kind of the paper P. Specifically, the electric field more adequate for electrophoresis than for the flight of the toner is assigned to a paper having a smooth surface, while the electric field for promoting the flight of the toner is assigned to a plain paper. For this purpose, a key may be operated by the user in order to select either one of the above two different kinds of electric fields for the second transfer. Alternatively, a sensor capable of automatically sensing the kind of the paper may be provided in the copier, in which case the electric field for the second transfer will be automatically switched.

Figure 10:
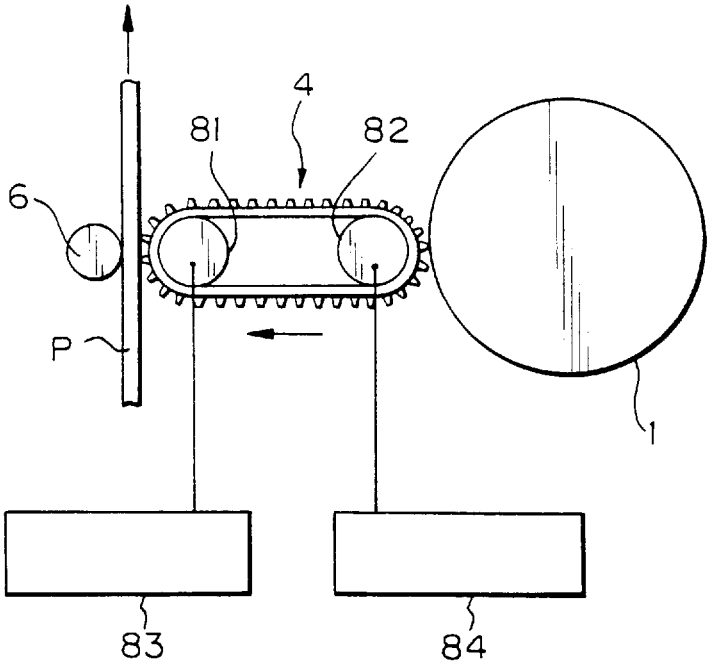
FIG. 10 shows a modification of any one of the embodiments.
Figure 11:
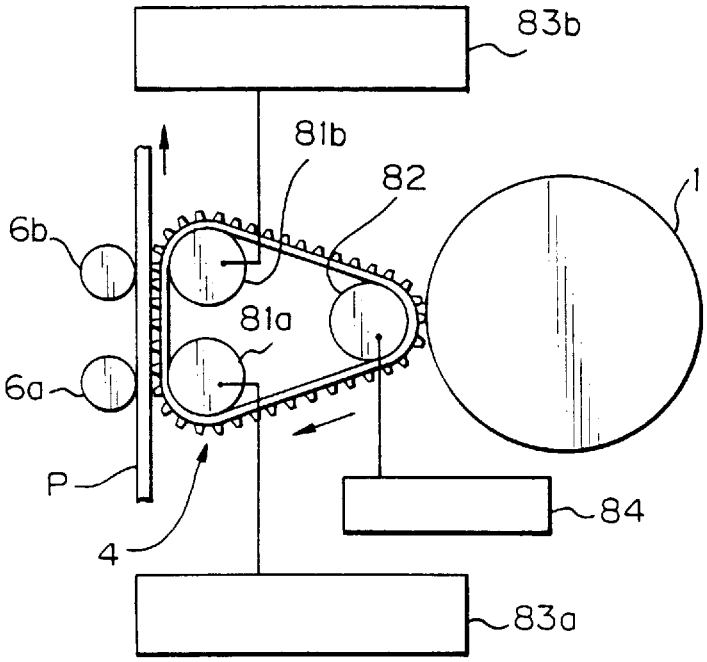
FIG. 11 shows another modification of any one of the embodiments.

FIGS. 10 and 11 each shows a particular modification of any one of the embodiments in which the intermediate transfer drum 4 is replaced with an intermediate transfer belt 4. As shown in FIG. 10, the belt 4 is passed over the voltage applying members 81 and 82 implemented as rollers. The belt 4 faces the drum 1 at one end and faces the transfer roller 6 at the other end. Voltages are applied from the power sources 83 and 84 to the rollers 81 and 82, respectively. The rollers 82 and 81 respectively play the role of the voltage applying members assigned to the first transfer and second transfer.

The modification shown in FIG. 11 is similar to the modification of FIG. 10 except that two rollers 81*a* and 81*b* are substituted for the roller 81. The rollers 81*a* and 81*b* hold the belt 4 in contact with the paper P. The rollers 81*a* and 81*b* are spaced from each other by a preselected distance in order to increase the area over which the belt 4 and paper P contact. This successfully increases the probability of transfer of the toner from the drum 4 to the paper P. The transfer roller 6, FIG. 10, is also replaced with two transfer rollers 6*a* and 6*b* facing the rollers 81*a* and 81*b*, respectively. The rollers 81*a* and 81*b* may be applied with the same voltage for forming the electric field for the second transfer. In the illustrative embodiment, power sources 83 and 83*b* each outputting a particular voltage are connected to the rollers 81*a* and 81*b*, respectively. For example, the voltage for forming the electric field adequate for electrophoresis is applied to one roller while the voltage adequate for the flight of the toner is applied to the other roller. In this condition, the toner can fly via both the portions between the developing liquid on the drum 4 and the surface of the paper P and filled with the liquid and the portions not filled with the liquid. For example, the former voltage and the latter voltage may be respectively applied to the upstream roller 81*a*, with respect to the direction of paper conveyance, and the downstream roller 81*b*. In this case, the toner is caused to move toward the paper P by electrophoresis in the former part of the paper transfer region while the toner failed to so move is caused to fly toward the paper P in the latter part of the same region. If leak is apt to occur between the rollers 81*a* and 81*b* shown in FIG. 11, a leak preventing plate should preferably be located between them.

In summary, it will be seen that the present invention provides a wet image forming apparatus having various unprecedented advantages, as enumerated below.

(1) Projections formed on an intermediate transfer body contact the surface of an image carrier and that of a paper, guaranteeing a distance between the bottoms of recesses of the intermediate transfer body and the above surfaces. Therefore, a toner image formed on the image carrier is prevented from being smashed by a pressure. This insures desirable transfer of the toner image from the image carrier to the intermediate transfer body, and thereby prevents image quality from being lowered on the paper.

(2) The surface of the intermediate transfer body is uneven. Therefore, when a developing liquid is transferred from the image carrier to the intermediate transfer body, the liquid existing in the background of the image carrier is not transferred to the intermediate transfer body. This prevents the wasteful deposition of the liquid on the paper and thereby reduces the consumption of the liquid.

(3) The intermediate transfer body with the uneven surface is formed of metal and therefore low cost.

(4) Leak between the intermediate transfer body and the image carrier is obviated when a voltage for causing first transferring means to form an electric field is applied; the leak would result in a defective image. When image transfer from the intermediate transfer body to the paper is also implemented by an electric field, there can also be obviated leak between the intermediate transfer body and an exclusive transfer electrode.

(5) The uneven surface of the intermediate transfer body is treated to increase a contact angle between it and the developing liquid. Therefore, when the film on the image carrier has a thickness greater than the height of the projections, the toner image transferred to the intermediate transfer body is prevented from expanding and insures faithful image transfer.

(6) The height of the projections is selected in accordance with the kind of the paper, so that high image quality matching the kind of the paper is achievable. Because the carrier liquid is prevented from depositing in an excessive amount on the portion where the toner is deposited. This also reduces the wasteful consumption of the developing liquid and thereby reduces the running cost.

(7) The developing liquid removed from the intermediate transfer body by cleaning means is stored in storing means and can be discarded. Should the collected liquid containing impurities be used again by developing means, it would change the characteristic of the entire liquid and would lower durability.

(8) The first transferring means includes a voltage applying member for forming an electric field or a magnetic field generating member for forming a magnetic field. Likewise, second transferring means includes a voltage applying member or a magnetic field generating member. Such members of the first and second transferring means are implemented as independent members each being located at a particular position. Therefore, a particular voltage for forming an electric field adequate for the individual transfer mechanism can be applied to each of the two members. This is not practicable if, e.g., the base of the intermediate transfer body is formed of a conductor and shared by the members of the first and second transferring means. With the independent members, it is possible to effect each of the transfer from the image carrier to the intermediate transfer body and the transfer from the intermediate transfer body to the paper adequately. This not only enhances image quality, but reduces the amounts of the liquid to remain on the image carrier and intermediate transfer body and thereby reduces the cleaning load while extending the life of a cleaning member.

(9) The intermediate transfer body has a base and a surface layer formed on the base and including projections or particles forming the projections, i.e, a plural layer structure. This allows each layer to have a particular function. Specifically, the base and surface layer or particles can each be selected from a broad range of materials such that, e.g., the former mainly implements durability while the latter mainly implements elasticity when the projections contact the surface of the image carrier. Because the base is formed of an insulator or a medium resistance material, the leak of the voltage for forming the electric field can be reduced or fully obviated. In addition, the electric characteristic for reducing or obviating the leak is assigned to the base, limitations ascribable to the electric characteristic of the surface layer or that of the particles are reduced.

(10) An AC electric field or a pulse-like electric field formed by the second transferring means activates the movement of the toner in the developing liquid between the surface of the intermediate transfer body and the paper. As a result, the transfer efficiency from the intermediate transfer body to the paper is improved. This kind of electric field activates not only the movement of the toner from the intermediate transfer body to the paper, but also the reverse movement of the same from the paper to the intermediate transfer body, depending on its waveform. Actually, however, the reverse movement of the toner is not activated when use is made of a plain paper whose fibers appear on the surfaces, because the fibers easily trap the toner of the liquid penetrated thereinto. Consequently, the transfer efficiency from the intermediate transfer body to the paper increases.

(11) A DC electric field formed by the first transferring means causes the toner to move from the image carrier toward the intermediate transfer body. During the transfer by the first transferring means, the intermediate transfer body faces the image carrier whose surface has a preselected degree of smoothness, as distinguished from the paper relating to the second transferring means. Therefore, should an AC electric field or a pulse-like electric field mentioned in relation to the second transferring means be used, the toner would move back and forth between the image carrier and the intermediate transfer body, obstructing the efficient movement of the toner from the image carrier toward the intermediate transfer body. In accordance with the present invention, the first transferring means uses the AC voltage while the second transferring means uses the AC electric field or the pulse-like electric field. This successfully enhances efficient transfer at each of the two consecutive stages.

(12) Only if the intensity of the AC electric field or that of the pulse-like electric field is adequately selected, the developing liquid in the recesses of the intermediate transfer body flies even to the dimples of the paper not contacting the above liquid. As a result, the toner image is transferred without any local omission. It follows that an attractive image free from local omission is achievable even when the plain paper is used.

(13) Switching means allows the intensity or the waveform of the AC electric field or that of the pulse-like electric field to be switched, so that an image matching the kind of the paper or the user's taste can be produced. Specifically, the adequate intensity or waveform of the electric field depends on the kind of the paper, particularly the smoothness of its surface. For example, when use is made of the plain paper whose fibers appear on the surfaces and can absorb the developing liquid, relatively high intensity should preferably selected with priority given to the flight of the toner. On the other hand, when use is made of a coated paper whose surface is smooth, excessively high intensity would cause the toner to move back and forth and would thereby lower the transfer efficiency.

(14) The thickness of the film formed on the image carrier by the developing means and the height of the projections are selected such that the developing liquid in the portion where the toner is deposited can contact the bottoms of the recesses of the intermediate transfer body. This insures desirable transfer from the image carrier to the intermediate transfer body including the bottoms of its recesses. Consequently, desirable toner transfer and therefore high image quality is attainable.

Various modifications will become possible for those skilled in the art after receiving the teachings of the present disclosure without departing from the scope thereof. For example, while the illustrative embodiments have been shown and described as implementing both the transfer from the drum 1 to the drum 4 and the transfer from the drum 4 to the paper P by use of an electric field, the present invention is similarly applicable to an apparatus of the type effecting one or both of the first and second transfer by a magnetic field.

What is claimed is:

1. An image forming apparatus using a developing liquid carrying toner particles, comprising:

a latent image forming unit configured to form a latent image on an image surface of an image carrier;

a developing unit configured to feed the developing liquid and toner particles to said image surface to develop said latent image so as to form a developed image as a film having first film portions of developing liquid and toner particles and second film portions of developing liquid without toner particles; and an image transfer unit configured to transfer at least part of each first film portion with included toner particles from said developed image to form a recorded image on a recording medium, said image transfer unit comprising, an intermediate transfer body having a number of projections of predetermined height extending from a lower surface of said transfer body, said projections defining side walls for recesses having bottoms defined by the lower surface, said predetermined height of the projections providing a depth for said recesses that will accommodate toner particles transferred from the developed image without squeezing the toner particles in said recesses;

a first transfer device configured to transfer the at least part of each first film portion with included toner particles from said developed image to said recesses to form a transfer image, and a second transfer device configured to transfer the at least part of each first film portion with included toner particles from the recesses forming the transfer image to the recording medium to form the recorded image.

2. An apparatus as claimed in claim 1, wherein said projections each have a height greater than a thickness of the second film portions.

3. An apparatus as claimed in claim 1, wherein said intermediate transfer body projections and recesses are treated to increase a contact angle between said treated projections and recesses and the developing liquid.

4. An apparatus as claimed in claim 2, wherein a thickness for said first film portions and the predetermined height of said projections are selected such that the developing liquid and toner particles transferred from said first film portions of the developed image into the recesses as part of said transfer image can penetrate into dimples in a surface of the recording medium receiving said recorded image to a degree obviating local omission of parts of the recorded image relative to said dimples.

5. An apparatus as claimed in claim 2, further comprising:

a cleaning unit configured to clean said intermediate transfer body by removing any developing liquid and toner particles remaining on said intermediate transfer body after transfer of the transfer image to the recording medium; and a storing device configured to store the developing liquid and toner particles removed by said cleaning unit.

6. An apparatus as claimed in claim 1, wherein said first transfer device is further configured to form an electric field to provide the transfer of developing liquid and toner particles from the developed image to the recesses of said intermediate transfer body, said intermediate transfer body having a metallic body portion.

7. An apparatus as claimed in claim 6, wherein said intermediate transfer body projections and recesses are treated to increase a contact angle between said treated projections and recesses and the developing liquid.

8. An apparatus as claimed in claim 6, wherein a thickness for said first film portions and the predetermined height of said projections are selected such that the developing liquid and toner particles transferred from said first film portions of the developed image into the recesses as part of said transfer image can penetrate into dimples in a surface of the recording medium receiving said recorded image to a degree obviating local omission of parts of the recorded image relative to said dimples.

9. An apparatus as claimed in claim 6, wherein said projections are provided at least in part by surface variations in a surface of the metallic body.

10. An apparatus as claimed in claim 1, wherein said first transfer device is configured to form an electric field to provide the transfer of developing liquid and toner particles from the developed image to the recesses of said intermediate transfer body, said intermediate transfer body including a base formed of conductive material having surface variations forming said projections with either an insulator or a medium resistance material covering at least a tip portion of said projections.

11. An apparatus as claimed in claim 10, wherein said projections and recesses are treated to increase a contact angle between said treated projections and recesses and the developing liquid.

12. An apparatus as claimed in claim 10, wherein a thickness for said first film portions and the predetermined height of said projections are selected such that the developing liquid and toner particles transferred from said first film portions of the developed image into the recesses as part of said transfer image can penetrate into dimples in a surface of the recording medium receiving said recorded image to a degree obviating local omission of parts of the recorded image relative to said dimples.

13. An apparatus as claimed in claim 10, further comprising:

a cleaning unit configured to clean said intermediate transfer body by removing any developing liquid and toner particles remaining on said intermediate transfer body after transfer of the transfer image to the recording medium; and a storing device configured to store the developing liquid and toner particles removed by said cleaning unit.

14. An apparatus as claimed in claim 1, wherein said first transfer device is further configured to form an electric field to provide the transfer of developing liquid and toner particles from the developed image to the recesses of said intermediate transfer body, said intermediate transfer body including a base formed of a conductive material on which said projections are formed with each projection being configured to behave as an insulator or a medium resistance element.

15. An apparatus as claimed in claim 14, wherein said intermediate transfer body projections and recesses are treated to increase a contact angle between said treated projections and recesses and the developing liquid.

16. An apparatus as claimed in claim 14, wherein a thickness for said first film portions and the predetermined height of said projections are selected such that the developing liquid and toner particles transferred from said first film portions of the developed image into the recesses as part of said transfer image can penetrate into dimples in a surface of the recording medium receiving said recorded image to a degree obviating local omission of parts of the recorded image relative to said dimples.

17. An apparatus as claimed in claim 14, further comprising:

a cleaning unit configured to clean said intermediate transfer body by removing any developing liquid and toner particles remaining on said intermediate transfer body after transfer of the transfer image to the recording medium; and a storing device configured to store the developing liquid and toner particles removed by said cleaning unit.

18. An apparatus as claimed in claim 1, wherein said first transfer device is further configured to form an electric field to provide the transfer of developing liquid and toner particles from the developed image to the recesses of said intermediate transfer body, said intermediate transfer body including at least a base formed of a medium resistance material.

19. An apparatus as claimed in claim 18, wherein said intermediate transfer body projections and recesses are treated to increase a contact angle between said treated projections and recesses and the developing liquid.

20. An apparatus as claimed in claim 18, wherein a thickness for said first film portions and the predetermined height of said projections are selected such that the developing liquid and toner particles transferred from said first film portions of the developed image into the recesses as part of said transfer image can penetrate into dimples in a surface of the recording medium receiving said recorded image to a degree obviating local omission of parts of the recorded image relative to said dimples.

21. An apparatus as claimed in claim 18, further comprising:

a cleaning unit configured to clean said intermediate transfer body by removing any developing liquid and toner particles remaining on said intermediate transfer body after transfer of the transfer image to the recording medium; and a storing device configured to store the developing liquid and toner particles removed by said cleaning unit.

22. An apparatus as claimed in claim 2, wherein said intermediate transfer body projections and recesses are treated to increase a contact angle between said treated projections and recesses and the developing liquid.

23. An apparatus as claimed in claim 22, further comprising:

a cleaning unit configured to clean said intermediate transfer body by removing any developing liquid and toner particles remaining on said intermediate transfer body after transfer of the transfer image to the recording medium; and a storing device configured to store the developing liquid and toner particles removed by said cleaning unit.

24. An apparatus as claimed in claim 1, wherein a thickness for said first film portions and the predetermined height of said projections are selected such that the developing liquid and toner particles transferred from said first film portions of the developed image into the recesses as part of said transfer image can penetrate into dimples in a surface of the recording medium receiving said recorded image to a degree obviating local omission of parts of the recorded image relative to said dimples.

25. An apparatus as claimed in claim 24, further comprising:

a cleaning unit configured to clean said intermediate transfer body by removing any developing liquid and toner particles remaining on said intermediate transfer body after transfer of the transfer image to the recording medium; and a storing device configured to store the developing liquid and toner particles removed by said cleaning unit.

26. An apparatus as claimed in claim 1, further comprising:

a cleaning unit configured to clean said intermediate transfer body by removing any developing liquid and toner particles remaining on said intermediate transfer body after transfer of the transfer image to the recording medium; and a storing device configured to store the developing liquid and toner particles removed by said cleaning unit.

27. An apparatus as claimed in claim 1, wherein said first and second transfer devices each include a respective member located at a particular position to provide a transfer field to implement each respective transfer.

28. An apparatus as claimed in claim 27, wherein said respective members each form an electric field as said transfer field and said intermediate transfer body includes a base formed of either an insulator or a material having a medium resistance and a surface layer formed on said base, said surface layer being configured to directly provide said projections or to hold particles forming said projections.

29. An apparatus as claimed in claim 28, wherein a thickness of said first film portions and the predetermined height of said projections are selected such that the developing liquid and toner particles in said first film portions transferred from the developed image can contact the bottoms of the recesses.

30. An apparatus as claimed in claim 27, wherein said second transfer device respective member is configured to provide either an AC electric field or a pulsed electric field.

31. An apparatus as claimed in claim 30, wherein said first transfer device respective member is configured to provide a DC electric field.

32. An apparatus as claimed in claim 31, wherein an intensity of the AC electric field or the pulsed electric field is selected such that at least some of the toner particles in the recesses are caused to fly to dimples present in the surface of the recording medium receiving the recorded image which do not contact said developing liquid and toner particles in said recesses to a degree obviating local omission of part of the recorded image relative to said dimples.

33. An apparatus as claimed in claim 32, further comprising a switching device configured to select an intensity or a waveform of the AC electric field or the pulsed electric field.

34. An apparatus as claimed in claim 33, wherein a thickness of said first film portions and the predetermined height of said projections are selected such that the developing liquid and toner particles in said first film portions transferred from the developed image can contact the bottoms of the recesses.

35. An apparatus as claimed in claim 30, wherein an intensity of the AC electric field or the pulsed electric field is selected such that at least some of the toner particles in the recesses are caused to fly to dimples present in the surface of the recording medium receiving the recorded image which do not contact said developing liquid with toner particles in said recesses to a degree obviating local omission of part of the recorded image relative to said dimples.

36. An apparatus as claimed in claim 30, further comprising a switching device configured to select an intensity or a waveform of the AC electric field or the pulsed electric field.

37. An apparatus as claimed in claim 30, wherein a thickness of said first film portions and the predetermined height of said projections are selected such that the developing liquid and toner particles in said first film portions transferred from the developed image can contact the bottoms of the recesses.

38. An apparatus as claimed in claim 27, wherein a thickness of said first film portions and the predetermined height of said projections are selected such that the developing liquid and toner particles in said first film portions transferred from the developed image can contact the bottoms of the recesses.

* * * * *